United States Patent [19]

Bianchi et al.

[11] Patent Number: 4,713,882

[45] Date of Patent: Dec. 22, 1987

[54] DEVICE FOR COMPRESSING BY HAMMERING A TUBE OF A STEAM GENERATOR SET IN A TUBE PLATE

[75] Inventors: Claude Bianchi, Paris; Yves Fournier, Chatenoy le Royal; Paul Jacquien, Tassin la Demi Lune, all of France

[73] Assignee: Framatome, Courbevoie, France

[21] Appl. No.: 905,418

[22] Filed: Sep. 10, 1986

Related U.S. Application Data

[62] Division of Ser. No. 795,594, Nov. 6, 1985.

[30] Foreign Application Priority Data

Nov. 9, 1984 [FR] France ..... 84 17130
Jul. 3, 1985 [FR] France ..... 85 10175

[51] Int. Cl.[4] ..... B23P 15/26

[52] U.S. Cl. ..... 29/727; 29/90 A; 29/726; 51/411; 72/53

[58] Field of Search ..... 29/727, 726, 90 A, 33 T, 29/282; 72/53, 370; 51/411, 439

[56] References Cited

U.S. PATENT DOCUMENTS 3,914,815 10/1975 Kobayashi ..... 51/411
4,216,569 8/1980 Steller et al. ..... 29/727
4,475,370 10/1984 Stark et al. ..... 72/53
4,481,802 11/1984 Harman et al. ..... 72/53

FOREIGN PATENT DOCUMENTS 0005492 1/1978 Japan ..... 51/411
0211859 12/1983 Japan ..... 51/411
0006354 1/1985 Japan ..... 51/411
0737139 6/1980 U.S.S.R. ..... 29/90 A

*Primary Examiner*—Howard N. Goldberg
*Assistant Examiner*—Irene Graves Golabi
*Attorney, Agent, or Firm*—Pollock, Vande Sande & Priddy

[57] ABSTRACT

For the purpose of compressing by hammering a steam generator tube (1), there is directed a stream of gas at high velocity charged with particles having a particle size of between 50 and $500 \cdot 10^{-6}$ m, onto the inner surface of the tube (1). The jet of gas is directed onto the inner surface of the tube (1) in radial directions and onto the whole of the periphery of the tube. The flow of the mass of the particles is higher than 0.008 kg/sec for tubes having an inside diameter of around 0.020 m. The device comprises a flexible sheath (20) movable inside a case (16, 18) fixed in a sealed manner under the tube plate (2) around the tube (1). An injection nozzle (21) is disposed at the end of the sheath (20) receiving the gas charged with particles.

12 Claims, 10 Drawing Figures

FIG. 2a
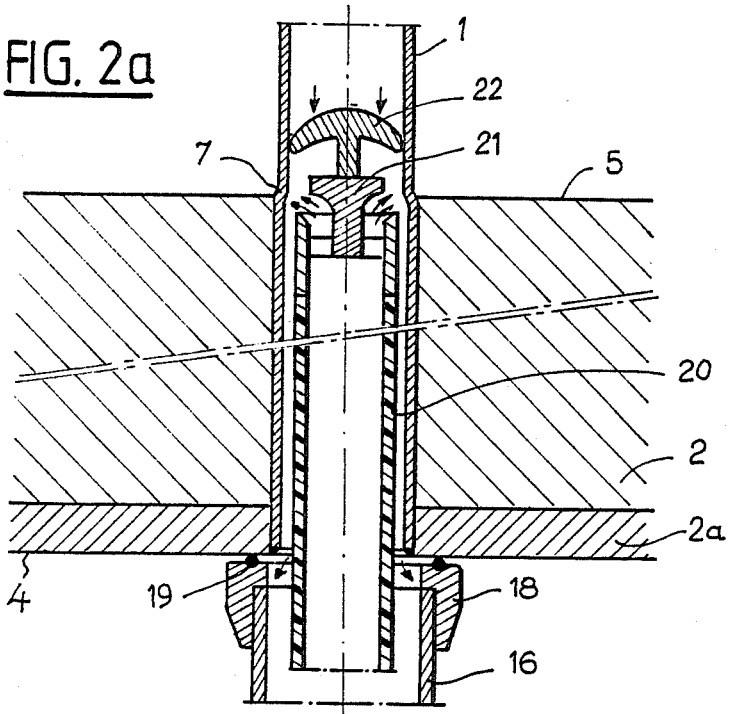
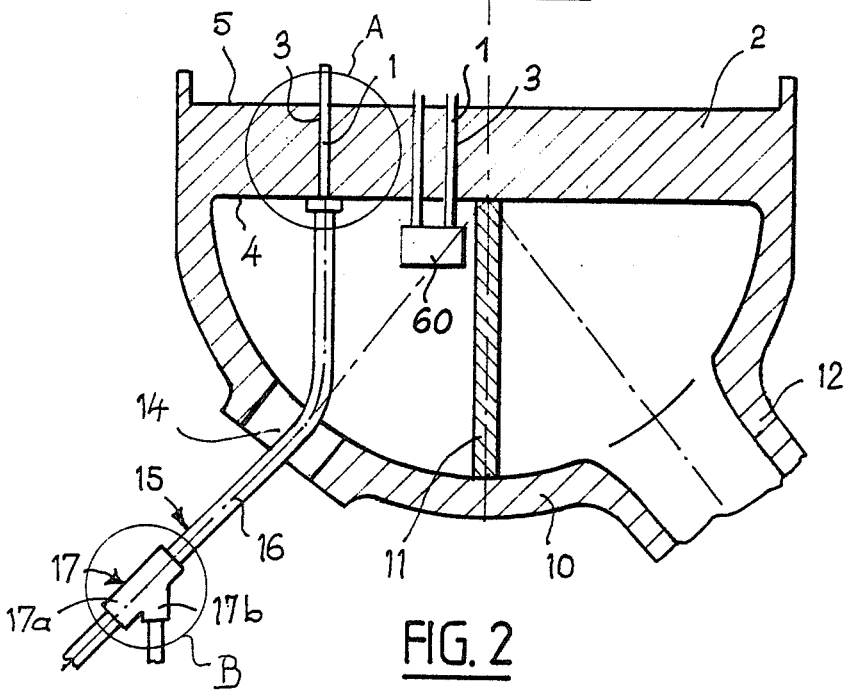
FIG. 2

DEVICE FOR COMPRESSING BY HAMMERING A TUBE OF A STEAM GENERATOR SET IN A TUBE PLATE

This is a division of application Ser. No. 795,594, filed Nov. 6, 1985.

BACKGROUND OF THE INVENTION

The invention relates to an apparatus for compressing by hammering a steam generator tube set in a tube plate for the purpose of limiting corrosion under stress.

Steam generators of pressurized-water nuclear reactors comprise a very thick tube plate in which the tubes of the nest of tubes of the generator are set at each of their ends. The tubes are flush with one of the sides of the tube plate which comes in contact with the primary fluid during the operation of the steam generator and project from the other side of the tube plate and communicate with the interior of the body of the steam generator receiving the water to be vaporized.

The setting or expansion of the tubes is carried out by introducing a tool, termed a tool-expander, inside the tube for rolling its wall inside its cavity in the tube plate. This rolling of the tube is carried out from the end thereof which is flush with the first side of the tube plate up to a zone located substantially in the vicinity of the second side of the tube plate. This zone of the tube located in the vicinity of the outlet side of the tube plate therefore constitutes the zone of separation between the part of the tube which is deformed by rolling in the corresponding bore of the tube plate and the undeformed part of the tube. This zone is termed the transition zone. In the transition zone, the wall of the tube is the centre of considerable residual tensile stresses which reduce the resistance of the tube to corrosion both on its outer surface in contact with the water to be vaporized and on its inner surface in contact with the primary fluid.

Indeed, there is found, in steam generators of nuclear reactors, after a certain period of operation, a deterioration of certain tubes of the nest in the region where they extend out of the tube plate, ie in the vicinity of their transition zones. Destruction by corrosion is in the form of cracking or even holes in the wall of the tube. More or less serious deteriorations on the tubes in zones other than the transition zone have also been found in steam generators, after a certain period of operation. The origin of these deteriorations may be attributed in some cases to the presence of residual stresses, in particular in the inner skin of the tubes.

It has been proposed in French Pat. No. 77 13 196, filed by the company Framatome, to effect a mechanical de-stressing of the tubes of steam generators after their expansion in the tube plate. This de-stressing is achieved by means of a tube-expander of special design which enables a slight diametrical expansion of the tube in its transition zone to be achieved. This operation has for result to reduce the stresses in the wall of the tube in the vicinity of its outer surface which comes in contact with the water to be vaporized. In this way corrosion due to the supply water of the steam generator in the vicinity of the tube plate is reduced.

However, this mechanical de-stressing operation by a diametrical expansion with a tube-expander does not permit a reduction in the stresses in the wall of the tube in the vicinity of its inner surface, or stresses in the inner skin of the tube. Corrosion by the primary fluid consisting of water under pressure including boric acid and various conditioning bases, therefore remains considerable in the inner skin of the tube in the transition zone.

There has also been proposed a process for compressing by hammering of the inner surface of the tube in the transition zone. This hammering of the tube carried out by rotating at very high speed inside the tube a flexible band carrying balls of small size and composed of a hard material, enables the resistance of the tube to corrosion by the primary fluid to be increased. However, in the event of breakage of a ball of hard material, the rubbing of this ball, which has sharp edges, against the inner wall of the tube in the course of the rotation of the flexible band, produces grooves on the inner wall of the tube. These grooves facilitate the corrosion of the inner skin of the tube by the primary fluid.

Methods are also known for achieving an internal hardening of tubes such as cast steel tubes, which comprise projecting balls of hard material onto the inner surface of these cast tubes. However, this method has never been used for compressing the inner skin of expanded tubes of small diameter, such as generator tubes of a pressurized water nuclear reactor, whose inside diameter is a little less than 0.020 m. The operating procedure involved in the interior hardening of cast steel tubes are obviously not applicable in the case of expanded tubes. It is also quite clear that the devices employed for the internal hardening of the cast tubes are not applicable in the case of tubes expanded in the tube plate of a steam generator and more particularly in the case where the operations are carried out on a pressurized water nuclear reactor steam generator, after it has been put into service, since the tubes and the waterbox of the steam generator are then more or less irradiated.

In this case, the presence of an operator in the vicinity of the irradiated zone must be avoided as far as possible. Consequently, the whole of the tooling of the device must be maintained on the tube plate, and the seal therebetween and the latter must be ensured and the movements of translation of the nozzle in the tube must be controlled automatically, and these various stages of the operation must be supervized without intervening in the steam generator.

SUMMARY OF THE INVENTION

An object of the invention is therefore to provide a process for compressing by a surface hammering a steam generator tube set in a tube plate so that one of its ends is flush with one of the sides of the tube plate and the tube projects from the other side of said plate, the setting of the tube being achieved by rolling its wall inside the tube plate, between its end flush with the first side of the plate and a zone located at the level of the second side of the plate, said process permitting the creation of compressive stresses in the internal skin of the tube and therefore improving the resistance to corrosion by the primary fluid of the steam generator flowing through the tube, without risk of grooves being formed on the inner surface of the tube.

For this purpose, a stream of gas at high velocity and charged with particles of a material having a hardness higher than the hardness of the material of the tube and a particle size of between 50 and $500.16^{-6}$ m, is directed onto the inner surface of the tube in radial directions relative to the tube and throughout its periphery, the velocity of the gas and the density of the particles in this gas being such that the flow of the mass of the particles striking against the inner surface of the tube for achieving the de-stressing thereof is higher than 0.008 kg/sec and preferably higher than 0.010 kg/sec, for a tube having an inside diameter of around 0.020 m.

The invention also provides a device for carrying out the process according to the invention, in particular on a pressurized water nuclear reactor steam generator after it has been put into service.

BRIEF DESCRIPTION OF THE DRAWINGS

There will now be described by way of a non-limiting example, with reference to the accompanying drawings, a manner of carrying out the process according to the invention and several embodiments of a device employed for this process.

In the drawings

FIG. 2 is a sectional view of a water-box of a steam generator of a pressurized water nuclear reactor in which tooling has been placed in position for carrying out the process according to the invention;

FIG. 2*a* is a sectional view to an enlarged scale of the detail A of FIG. 2 diagrammatically representing the tooling in the operating position in the region of the transition zone of a tube;

FIG. 1 shows a tube 1 of a steam generator set in a throughway bore 3 in a tube plate 2. The setting of the tube 1 was achieved by expanding the tube, ie by rolling the wall of the tube inside its bore, between the inlet side 4 of the tube plate and the outlet side 5 through which the tube enters the steam generator body. The end 1*a* of the tube 1 is flush with the side 4 of the tube plate and a weld between this end 1*a* of the tube and the tube plate completes the fixing of the tube.

Figure 1:
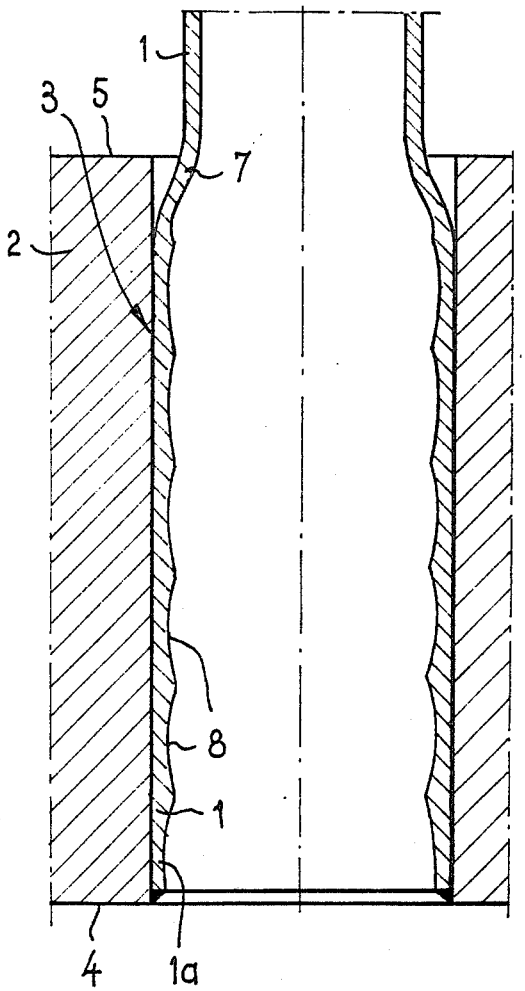
FIG. 1 is a semi-sectional view of an expanded tube in a tube plate, before its has been de-stressed.

It can be seen that the deformed part of the tube has successive rolled zones 8 corresponding to the different positions of the tube-expander inside the tube during the setting of the latter. At the level of the outlet side 5 of the tube plate, the tube 1 has a transition zone 7 of a certain length between its deformed part and its undeformed part which remains at its nominal diameter. In this zone 7, residual tensile stresses appear in the internal skin and the external skin of the tube after setting.

There is seen in FIG. 2 the lower part of a steam generator including the tube plate 2 through which extend tubes such as 1 and a hemispherical water-box 10 on the side of the inlet side 4 of the tube plate.

The water-box 10 is divided into two by a partition wall 11, the water under pressure constituting the primary fluid being supplied to the water-box on one side of the partition wall 11 and issuing from this water-box on the other side through pipes such as 12. Each tube 1, which is bent into a U-shape, has one of its ends opening into one part of the water-box and its other end opening into the other part of the water-box. The primary fluid can thus flow inside each of the tubes in the upper part of the steam generator (not shown) in FIG. 2, above the outlet side 5 of the tube plate 2.

Also shown in FIG. 2 is tooling 15 introduced in the water-box of the steam generator through an inspection hole 14. This tooling is placed in position and held inside the tube plate during the de-stressing operation carried out on the tubes by a tool-holder 60 whereby it is possible to place the tooling successively in each of the tubes to be stressed. This tool-holder may be of the type disclosed in FR-A-2 309 314 filed by the applicant.

Figure 2B:
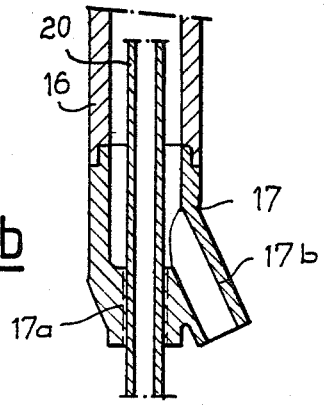
FIG. 2*b* is an enlarged view of the detail B of FIG. 2.

There will now be described the tooling 15 with reference to FIGS. 2*a* and 2*b*. This tooling comprises an outer sheath 16 connected at one end to a branch coupling 17 and engaged at its other end in a fixing bell 18 maintained under the tube plate 2 by the tooling support with interposition of a sealing element 19 between the bell 18 and the inlet side 5 of the tube plate constituted by the coated surface 2*a* of this plate which comes in contact with the primary fluid.

Engaged inside the sheath 16 is a sheath 20 of smaller diameter carrying in its upper part a shaped nozzle 21 surmounted by a centering plug 22 whose outside diameter corresponds to the nominal inside diameter of the tube 1.

Upstream of the branch sleeve 17, the inner sheath 20 is connected to a particle-injecting unit comprising means for pumping air under pressure, and a distributor of a metered amount of particles in the stream of air under pressure. When the tooling is in operation, air charged with particles travelling at high velocity thus arrives in the central sheath 20 of this tooling. The particles are formed by micro-balls of non-magnetic stainless steel whose particle size is between 100 and $300.10^{-6}$ m. If the centering plug 22 does not completely close the tube 1, air is injected in the upper part of the tube above the plug 22 so as to urge the balls back in the downward direction.

The outer sheath 16 and the inner sheath 20 of the tooling are formed in a part of their length by flexible tubes which may be subjected to bending for their orientation inside the water-box of the steam generator.

The inner sheath 20 is slidably mounted in the branch 17*a* of the branch coupling 17 so as to be guided at its entrance in the outer sheath 17. The branch 17*b* of the branch coupling 17 is connected to a pumping station so that a suction can be created in the outer sheath 17 around the inner sheath 20.

To employ the device, the steam generator being inoperative, cooled and emptied of its water; the bell 18 and the outer sheath 17 are placed in position under the tube plate vertically below a tube 1 by a tooling support which may be shifted inside the water-box, and the inner sheath 20 is engaged in the outer sheath 17 so that the upper part comprising the injection nozzle 21 is in confronting relation to the transition zone 7 of the tube. The inner hammering is then carried out on the tube throughout the length of the transition zone by moving the sheath 20 and the nozzle 21 in translation in the upward direction at a slow and even speed on the order of 0.002 m/sec, the inner sheath 20 being supplied with a mixture of air or other gas under pressure and very hard micro-balls. In the case of steam generator tubes of nickel alloy whose inside diameter is in the neighbourhood of 0.020 m, a zone of the tube located on each side of the outlet side of the tube plate is swept through over a length of around 0.20 m, this zone surrounding the transition zone. The regulation of the air flow and the density of the charge of micro-balls in this projecting air is such that the flow of the mass of the balls is around 0.010 kg/sec. The mirco-balls propelled in the air at high velocity (around 300 m/sec) have a path which is deviated by the nozzle 21 in such manner that their direction is substantially radial when they strike against the inner surface of the tube in the transition zone. The distribution of the balls is substantially homogeneous so that the whole of the periphery of the tube is subjected to a hammering or peening.

After their impact, the balls are aspirated into the space around the sheath 20, first of all inside the tube 1 in the tube plate, and then in the outer sheath 16 before being recovered on the downstream side of the couplings 17.

In the part of the tube rolled inside the tube plate, the balls effect, when they return with the projecting air aspirated by the pumping unit, a hammering of this part of the tube comprising slight asperities between the rolled zones 8.

With reference to FIGS. 3 to 7, there will now be described a preferred embodiment of the device for compressing by hammering tubes of the steam generator shown in FIG. 2. The corresponding elements of the device shown in FIGS. 2*a* and 2*b* and of the device shown in FIGS. 3 to 7 carry the same reference characters.

This device comprises in its upper part an injection head generally designated by the reference numberal 31 and formed by a rigid tubular body 32. A sleeve 33 (FIG. 4) provided with a circular end sealing element 34, is screwed on the upper part of the body 32.

The whole of the injection head 31 is positioned in alignment with the tube 1 which opens onto the tube plate 2, and maintained in position by the tool-holder 60 which is independently movable in the water-box. This tool-holder 60, partly shown in FIG. 4, comprises a jack 61 whose cylinder 62 is rigid with the tool-holder 60 and whose piston 63 is fixed to the body 32 of the injection head 31 by an extension rod 64 and a support 35. The jack 61 is so chosen that when there is a lack of pressure, the injection head 31 is in the upper position relative to the tool-holder 60. Consequently, when the tool-holder 60 is at a given distance from the tube plate 2 and the jack 61 is not subjected to a pressure of compressed air, the injection head 31 bears against the lower side 4 of the tube plate and the seal is ensured by the force exerted in the upward direction on the circular sealing element 34. The body 32 of the injection head 31 is flexibly mounted on the support 35 so as to correctly align the axis of the head with the axis of the tube 1 to be treated, even if there is a defective positioning of the tool-holder 60.

Figure 3:
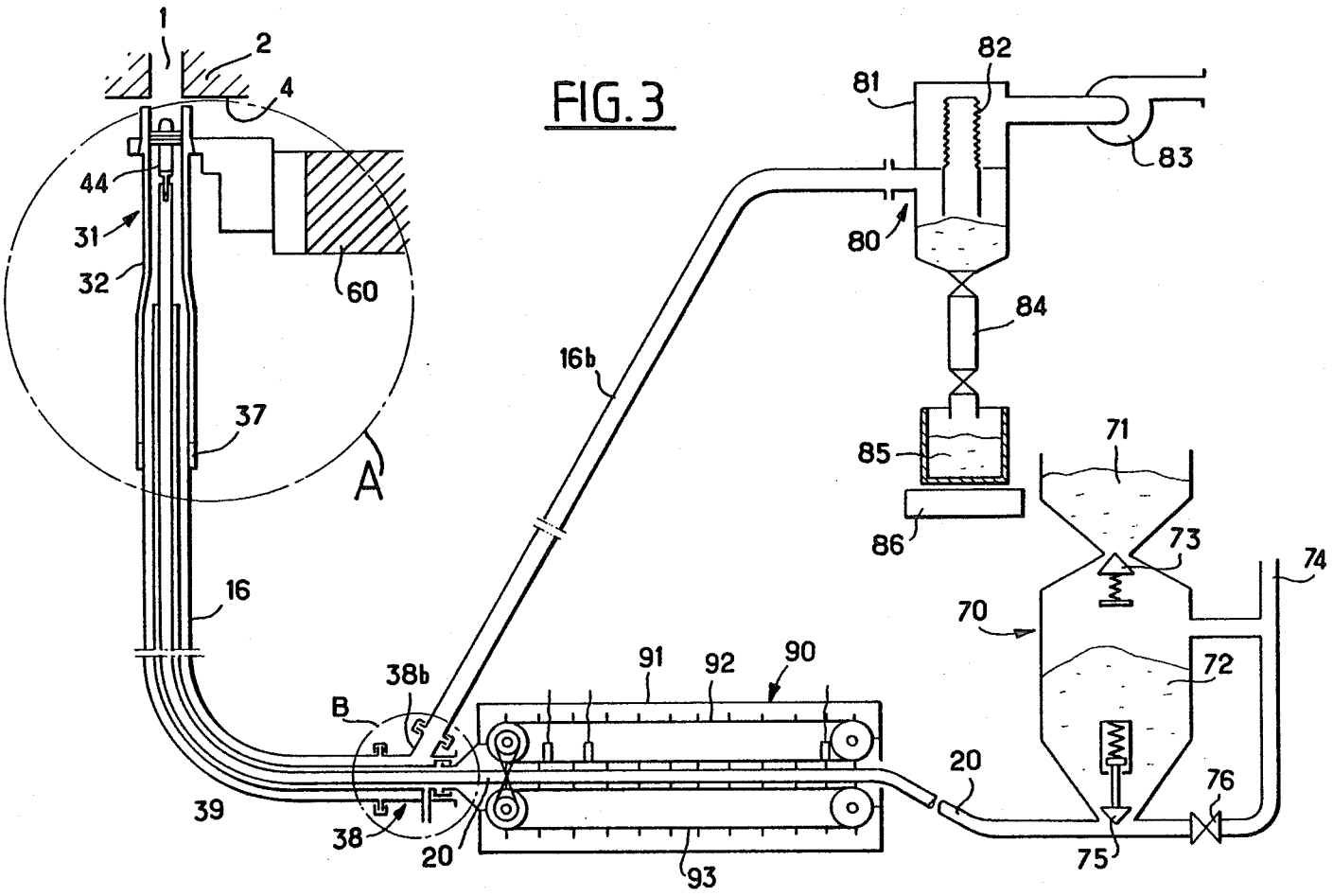
FIG. 3 is a diagrammatic view of the assembly of the device for carrying out the process according to the invention.
Figure 4:
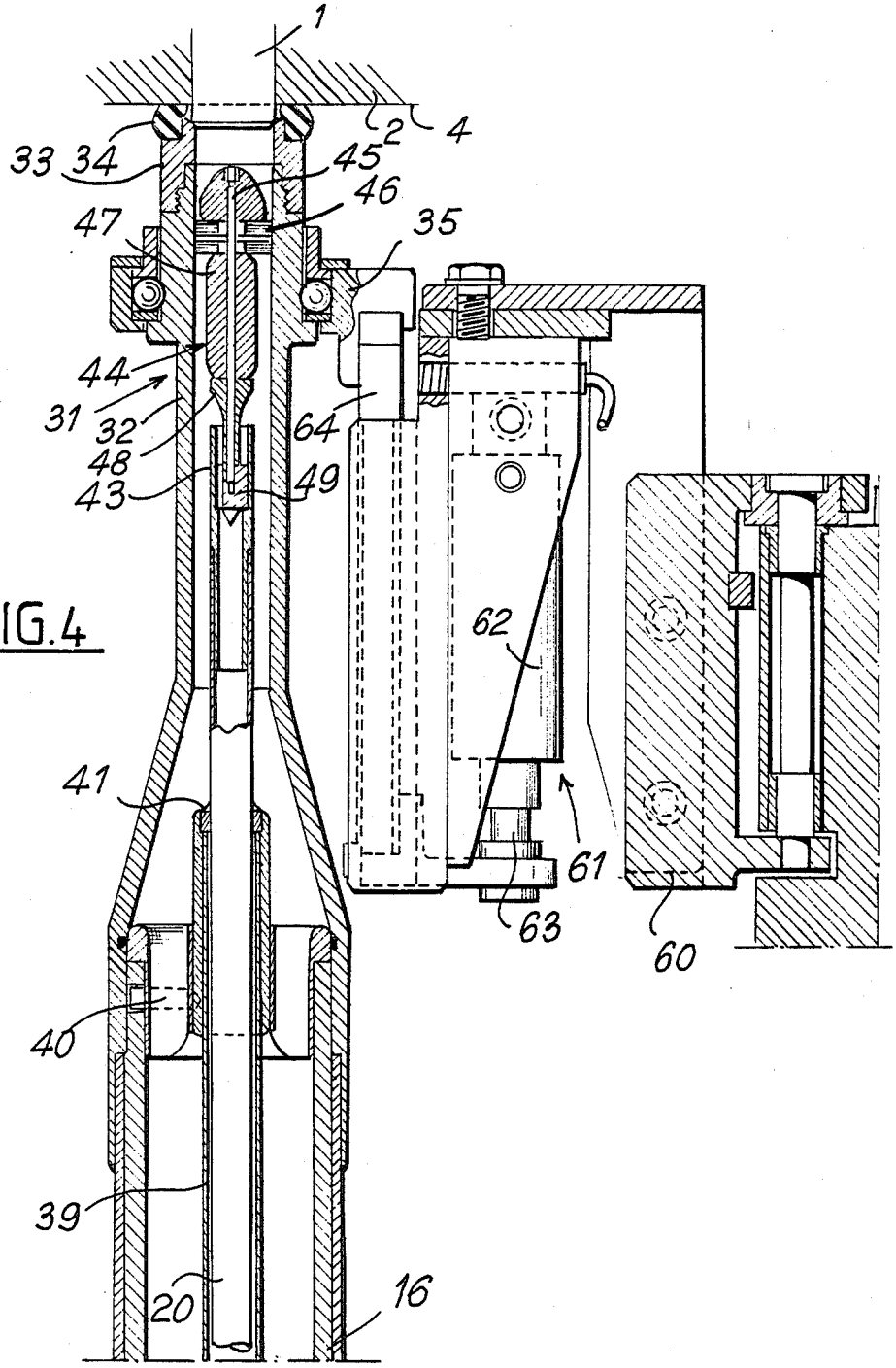
FIG. 4 is a view to an enlarged scale of the detail A of FIG. 3, in a preferred embodiment of the tooling.
Figure 5:
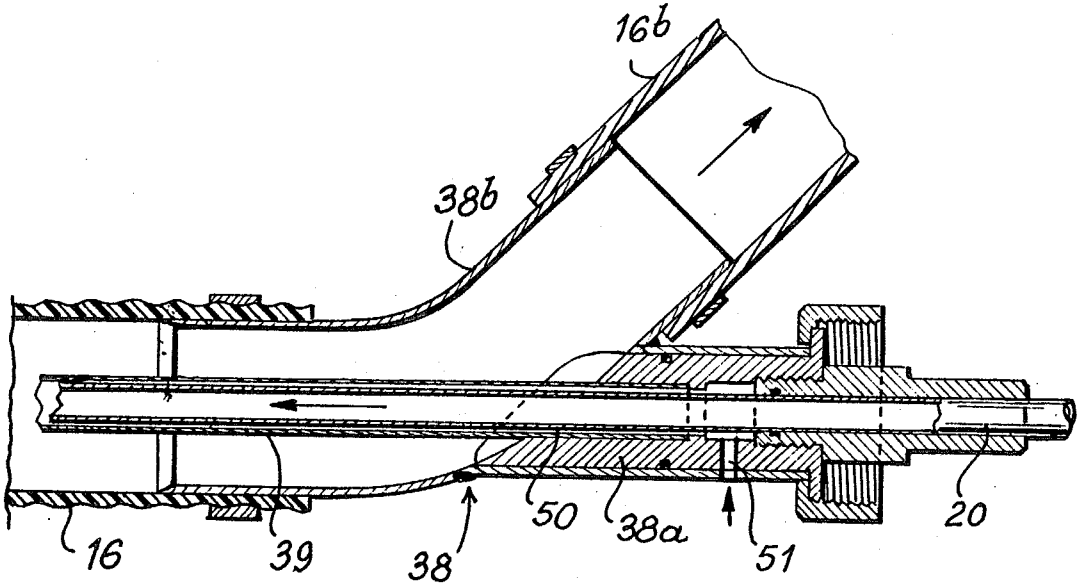
FIG. 5 is an enlarged view of the detail B of FIG. 3.

The lower part of the injection head 31 is connected to an outer sheath 16 by a rapidly uncoupled coupling 37 diagrammatically shown in FIG. 3. The other end of the outer sheath 16 is connected to a branch coupling 38.

Engaged inside the outer sheath 16 is an inner sheath 39 whose end opens into the injection head 31 and whose other end is also connected to the coupling 38.

The end of the inner sheath 39 is maintained in the injection head 31 by a centering member 40 (FIG. 4) which has the shape of a three-branch spider for the recycling of the particles, as will be explained hereinafter. The upper edge of the inner sheath 39 is provided with a sealing element 41 having lips.

The outer sheath 16 and the inner sheath 39 comprise flexible pipes which can be subjected to bending for their orientation inside the water-box of the steam generator.

Further, engaged inside the inner sheath 39 is a tubular sheath formed by a flexible tube 20 of smaller diameter and carrying, in its upper part, by means of a hollow coupling 43, an injection nozzle 44. The latter comprises a screw 45, on which are screwthreadedly engaged circular brushes 46 whose outside diameter substantially corresponds to the inside diameter of the tube 1, a spacer member 47 and a deflector 48. The whole of the nozzle 44, which constitutes an easily disassembled unit, is screwed by means of the screw 45 in a centering member 49 welded in the hollow coupling 43. This centering 49 has the shape of a three-branch spider so as to permit the passage of the particles supplied by the flexible tube 20. The spacer member 47 provides a constant distance between the brushes 46 and the deflector 48 which is therefore positioned in the vicinity of the outlet orifice of the hollow coupling 43. These brushes 46 center the injection nozzle 44 and clean the tube 1 when the nozzle is lowered. Further, they may also prevent the passage of the micro-balls.

The flexible tube 20 is slidably mounted in the branch 38*a* of the branch coupling 38 (FIG. 5) so as to be guided at its entrance into the inner sheath 39. Further, the inner sheath 39, whose end is fixed in the branch 38*a* of the coupling 38, defines along the flexible tube 20 a small annular space 50 which is connected through an orifice 51 provided in the branch 38*a* of the coupling 38 to a source of gas under pressure (not shown).

The gaseous stream thus produced in the annular space 50 serves to center the flexible tube 20 inside the inner sheath 39 and prevent any friction between these two elements when the injection nozzle 44 is introduced and during the displacement of the flexible tube. This gaseous stream prevents the return of the particles to this annular space.

With reference now to FIG. 3, it can be seen that the flexible tube 20 is connected, upstream of the branch coupling 38, to a particle injection unit 70. The particles may be formed by micro-balls composed of a metallic material, glass or ceramic material whose particle size is between 50 and 500 microns.

This unit 70 comprises a storage hopper 71 connected to a pressurizing tank 72 through a filling valve 73. This tank 72 is connected in its upper part directly to the compressed gas supply pipe 74 and in its lower part to the flexible tube 20 through a micro-ball injection valve 75. The flexible tube 20 is also connected to the compressed gas supply pipe 74 through a valve 76.

The branch 38*b* of the branch coupling 38, which communicates with the space between the outer sheath 16 and the inner sheath, is connected, through a sheath 16*b*, to a micro-ball pumping system 80. This pumping system comprises a separator 81 provided with a filter 82 for filtering the gas aspirated by a pump 83. In its lower part, the separator 81 is provided with a lock-chamber 84 for controlling the volume of the particles passing therethrough and communicating with a vessel 85 for recovering the micro-balls and equipped with a weighing device 86. The longitudinal movements of the flexible tube 20 and consequently of the injection nozzle 44, in the vapour generator tube to be hammered, are ensured by a feed mechanism 90 disposed between the branch coupling 38 and the injection unit 70.

Figure 6:
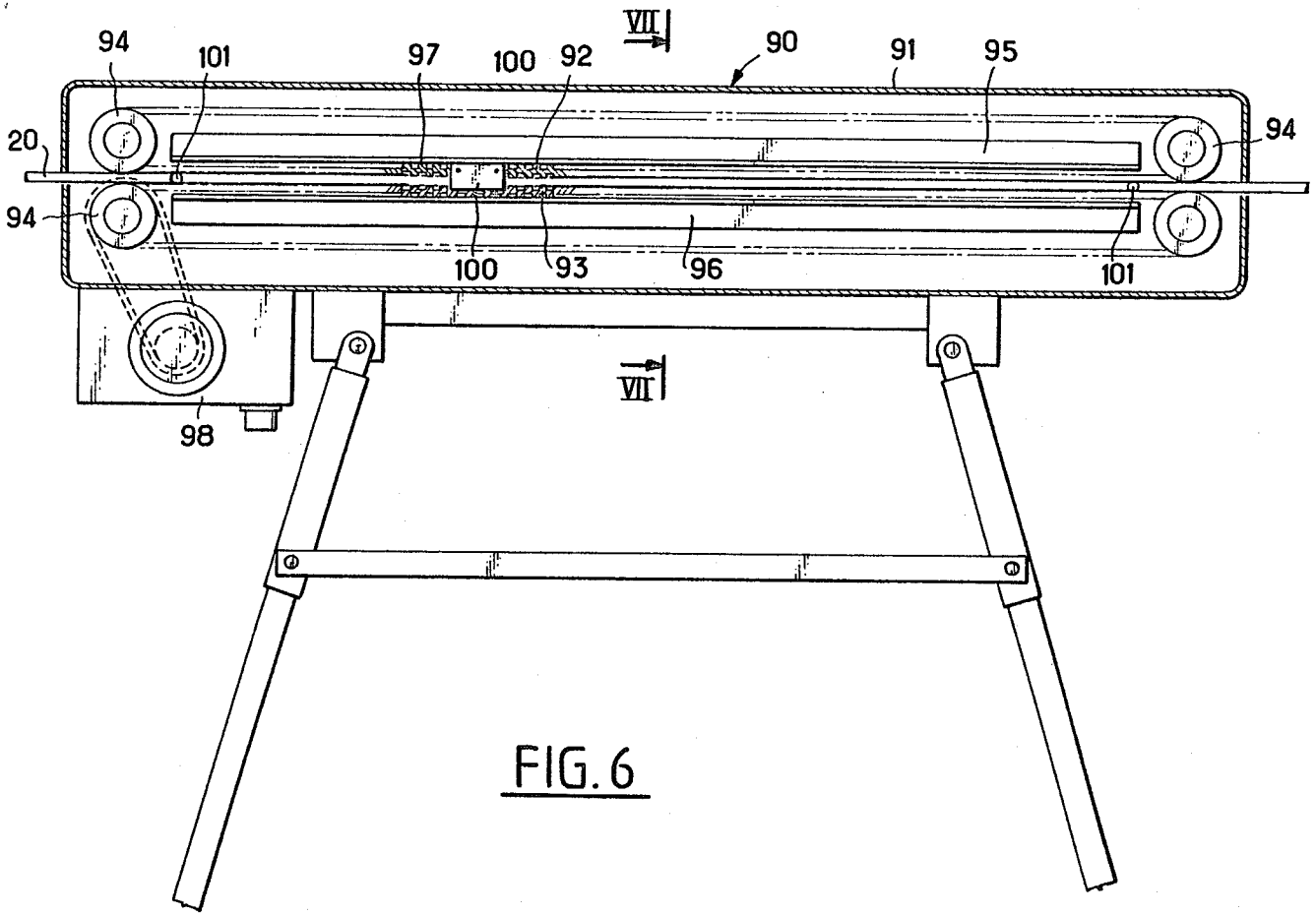
FIG. 6 is an elevational view of the mechanism for advancing the pipe of the injection nozzle.
Figure 7:
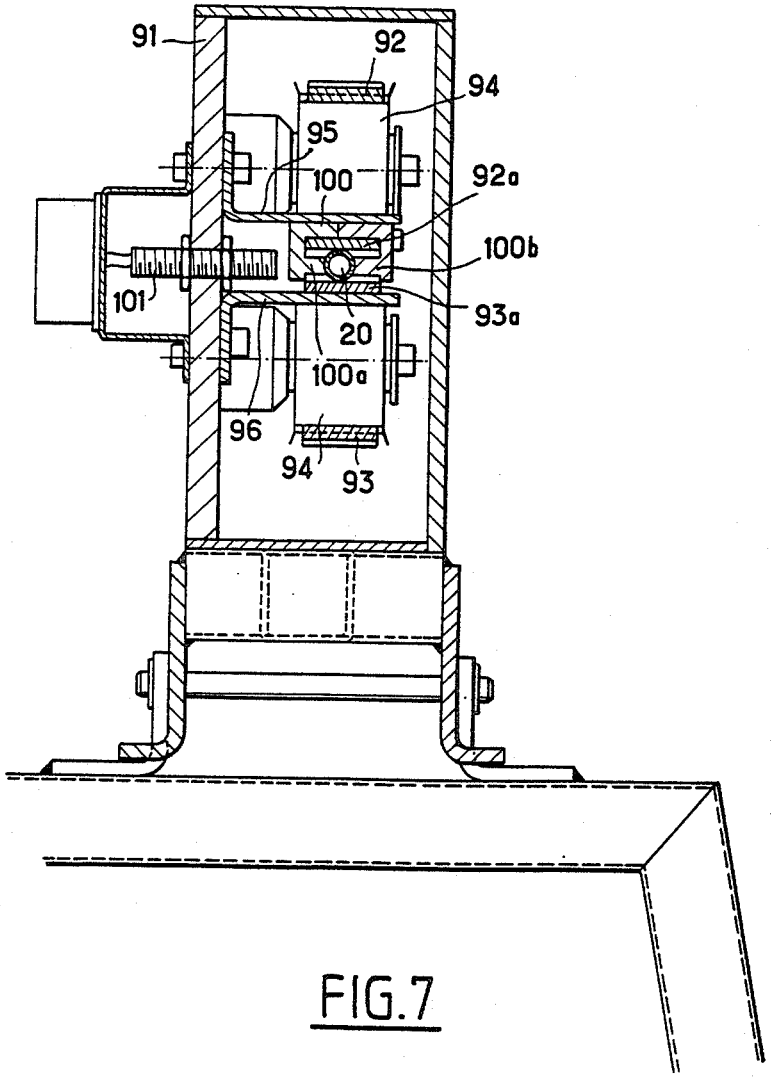
FIG. 7 is a sectional view to an enlarged scale taken on line VII—VII of FIG. 6.

This feed mechanism 90, shown in more detail in FIGS. 6 and 7, comprises a parallel-sided frame 91 constituting a longitudinal cage in which two toothed belts 92 and 93 are mounted. These two belts 92 and 93 are guided at each end of the frame 91 by pulleys 94 and by L-section members 95 and 96 fixed to one of the walls of the frame 91 between said pulleys.

The belts 92 and 93 each comprise a longitudinal groove 92*a* and 93*a* and define therebetween on the axis of the frame a longitudinal passageway 97. Introduced in this longitudinal passageway 97 is the flexible tube 20 which is positioned in the grooves 92*a* and 93*a* of the belts 92 and 93 so as to be guided thereby in the course of its displacement.

The belts 92 and 93 are driven by a motor 98 whose output shaft is connected to one of the pulleys 94 through a drive system 99.

The transmission of the longitudinal movement between the belts 92 and 93 and the flexible tube 20 is controlled by an element 100 connected to the belt 92 and including two inner branches 100*a* and 100*b* which pinch the tube 20.

In order to control and limit the displacement of the flexible tube 20, detectors 101 of the position of the element 100 are mounted on the axis of the longitudinal passageway 97.

The device is used in the following manner:

The injection head 31 is placed in position under the tube plate 2 vertically below a tube 1 by the tool-holder 60 which may be displaced inside the water-box, and the injection head 31 is connected to the outer sheath 16 by the coupling 37. The inner sheath 39 is introduced in the outer sheath 16 and the branch coupling 38 is mounted and connects the branch 38*b* to the sheath 16*b*.

The injection nozzle 44 is mounted on the hollow coupling 43 and the flexible tube 20 is engaged inside the inner sheath 39. The gaseous flow introduced in the space 50 ensures the guiding of the flexible tube in the inner sheath 39 and avoids any friction.

The flexible tube 20 is then shifted in such manner that the upper part including the injection nozzle 44 is in confronting relation to the zone of the tube to be hammered or beened. The hammering is then effected inside the tube throughout the desired length by moving in translation by means of the feed and control mechanism 90 the flexible tube 20 and the nozzle 44 at a slow and regular velocity, the tube 20 being supplied by the injection unit 70 with a mixture of air or other gas under pressure and very hard micro-balls. The micro-balls propelled in the gas at high velocity have a path which is deviated by the deflector 48 in such manner that their direction is substantially radial when they strike against the surface of the tube.

After their impact, the micro-balls are aspirated by the pumping system 80, first of all into the space between the outer sheath 16 and the inner sheath 39, then in the branch 38*b* of the coupling 38 and in the sheath 17*b*. Under the effect of the gas under pressure introduced in the space 50 and by means of the lip sealing element 41, the micro-balls cannot penetrate between the inner sheath 39 and the flexible tube 20.

The micro-balls are thus aspirated in the separator 81 and recovered in the lock-chamber 84, and then transferred to the recovering vessel 85 which is weighted. This final weighing is a way of ensuring that the quantity of recovered micro-balls is equivalent to the quantity of injected micro-balls.

Figure 8:
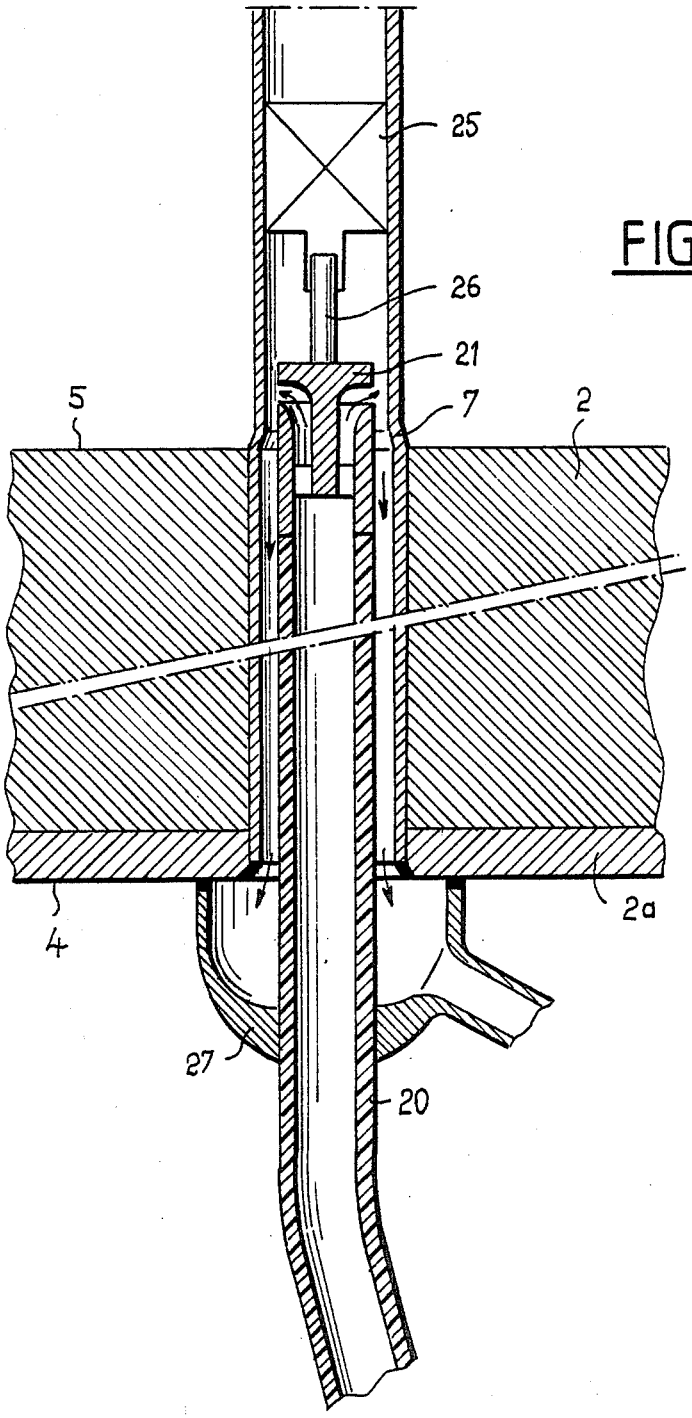
FIG. 8 is a sectional view of tooling for carrying out the process according to the invention in a modification.

FIG. 8 shows a slightly different embodiment of the hammering device, the corresponding elements of the device shown in FIG. 2*a* and of the device shown in FIG. 8 being designated by the same reference characters.

The flexible tube 20 for introducing the mixture of gas and micro-balls is engaged for its utilization in a guiding and sealing unit comprising an expansible plug 25 previously introduced in the tube to be de-stressed and a bell 27 for recovering the balls maintained in position under the tube plate 2 by a tooling support which is displaceable from one tube to another in the water-box of the steam generator. This bell 27 is connected to a pumping unit (not shown), and is mounted in a sealed manner by means of a sealing element under the inlet side 4 of the tube plate.

The nozzle 21 of the tooling is extended by a rod 26 slidably engaged in the plug 25 for guiding the nozzle in the transition zone 7 of the tube.

The operating procedure for achieving the de-stressing by an internal hammering or peening of the tube are the same as before. The micro-balls are recovered in the bell 27 after their impact against the walls of the tube.

It can be seen that the main advantages of the process and device according to the invention are that they permit achieving an internal hammering of the tube which is perfectly defined and only requires devices of simple design and easy to use at remote control.

Further, when the device is employed in the preferred embodiment, the displacements of the tooling are accompanied by very low friction: in the case where an intervention must occur on the injection nozzle 44, the operator can remotely control by means of the tool-holder 60 the displacement of the injection head 31 to the inspection hole 14 of the water-box of the steam generator. He can rapidly disconnect the injection head 31 from the outer sheath 16 by means of the coupling 37. This operation enables the injection nozzle unit 44 to be easily withdrawn by unscrewing the screwthreaded rod 45 and enables the parts 44, 47, 48 of which this nozzle is composed to be inspected or changed.

The scope of the invention is not intended to be limited to the embodiments and manner of proceeding described hereinbefore. Thus, it is possible to employ micro-balls or other particles composed of any metallic material or of a hard non-metallic material such as glass or ceramic material whose particle size may vary from 50 to $500.10^{-6}$ m and preferably between 50 and $250.10^{-6}$ m. The flow of the mass of these balls in the projecting air may be a little lower than that indicated, but this flow must not be less than 0.008 kg/sec in order to obtain an adequate hammering or peening effect with the velocities of the carrying gas and these particles at the moment of impact which are no lower than 50 m/sec, in the case of tools having a diameter of around 0.020 m.

Micro-balls or particles may be employed which have a shape different from the spherical shape. The material chosen for the micro-balls must have a hardness higher than the hardness of the material of the tube which is usually a nickel alloy in the case of steam generators of nuclear reactors.

The pressures of the gas carrying the micro-balls and/or the depression produced by the aspirating device may also be regulated in order to facilitate the recovery of the balls in the lower part of the tube.

In particular, it would be possible to employ solely aspiration means for ensuring the circulation and recovery of the balls.

These balls may be slightly contaminated after passage in the tubes of the steam generator, and it may be necessary to isolate them or de-contaminate them after their use.

Types of tooling other than those described may of course be contemplated for carrying out the process according to the invention. In particular, tooling may be designed for effecting the hammering by impact of the balls in parts of the tube other than the transition zone or the expanded zone inside the tube plate, for example tooling may be provided for hammering the internal surface of the tubes in their upper bent part.

It is also possible to imagine the use of the process and device according to the invention for compressing steam generator tubes which are different from the nickel alloy tubes of steam generators of pressurized water nuclear reactors.

This apparatus may be used not only for tubes of a steam generator already put into service but also for tubes of a new steam generator whose water-box has already been placed in position.

What is claimed is:

1. A device for compressing a steam generator tube set in a tube plate so that one end of the tube is flush with a first side of sides of the tube plate and the tube projects from a second opposite side of the tube plate, the setting of the tube having been effected by a rolling of the wall of the tube inside the tube plate between the end of the tube flush with said first side and a zone located in the region of said second side of the tube plate, said device comprising means fixed around the end of the tube flush with said first side of the tube plate in a sealed manner and constituting a case in which is slidable a first flexible tubular sheath, a shaped nozzle carried on an end of the first sheath, and guide means in the tube, suction means connected to the case, and means for injecting gas charged with particles connected to the first sheath, the nozzle having a portion for guiding the particles in a radial direction to the tube when the sheath is introduced in said tube and guided by said guide means.

2. A device according to claim 1, wherein the case comprises a bell fixed in a sealed manner under the tube plate and a second flexible sheath engaged by an end thereof in the bell and having an opposite end, a branch coupling connected to said opposite end of the second sheath and having a branch for the passage and the guiding of the first flexible sheath inside the second flexible sheath, and a branch connected to the suction means.

3. A device according to claim 1, wherein the case is fixed in a sealed manner around the end of the tube flush with said first side of the tube plate, the first sheath being formed by a flexible tubular element and slidable in the case which includes internal means for guiding and centering the flexible tubular element carrying at its end the nozzle for injecting the gas charged with particles.

4. A device according to claim 3, wherein the means for guiding and centering the flexible tubular element comprise an internal third sheath disposed around said flexible tubular element and defining with said flexible tubular element an annular space into which a means injects a gas under pressure in the same direction as the direction of flow of the particles.

5. A device according to claim 4, wherein the case is maintained in a sealed manner around the end of the tube by means comprising a tool-holder, a support connected to the tool-holder and an injection head comprising a body which is flexibly mounted on the support.

6. A device according to claim 5, comprising, for maintaining one of the ends of the inner third sheath in the injection head, a centering member having the shape of a spider, the third sheath having on its upper edge a sealing element having lips.

7. A device according to claim 6, wherein said spider has three branches.

8. A device according to claim 5, wherein a rapidly released coupling connects the lower part of the injection head to the outer case.

9. A device according to claim 1, wherein the injection nozzle is mounted on a centering member which is welded in a hollow sleeve fixed to the end of the flexible tubular element.

10. A device according to claim 9, wherein the injection nozzle constitutes an easily dismantled unit comprising a screw engaged in the centering member on which screw are mounted circular brushes, a spacer member and a deflector.

11. A device according to claim 9, wherein the centering member has the shape of a spider to permit the passage of the particles supplied through the flexible tubular element.

12. A device according to claim 1, wherein said spider has three branches.

* * * * *